United States Patent [19]

Dale

[11] Patent Number: 4,930,641

[45] Date of Patent: Jun. 5, 1990

[54] BLADED TOOL HOLDER

[76] Inventor: Jack F. Dale, 325 N. Main St., Mountain Grove, Mo. 65711

[21] Appl. No.: 380,388

[22] Filed: Jul. 17, 1989

[51] Int. Cl.[5] ..... A47F 7/00

[52] U.S. Cl. ..... 211/70.6; 211/89; 248/316.3

[58] Field of Search ..... 211/70.7, 89, 70.6, 211/45, 66; 248/316.2, 316.3, 37.3, 37.6

[56] References Cited

U.S. PATENT DOCUMENTS

| | | | |
|---|---|---|---|
| 2,051,541 | 8/1936 | Chanik | 248/316.3 |
| 2,953,255 | 9/1960 | Higgins | 211/70.7 X |
| 3,071,252 | 1/1963 | Hanschar | 211/70.7 |
| 4,134,499 | 1/1979 | Joswig | 211/70.6 X |
| 4,294,421 | 10/1981 | Kunstlicher et al. | 211/70.6 |

*Primary Examiner*—Robert W. Gibson, Jr.

*Attorney, Agent, or Firm*—Polster, Polster and Lucchesi

[57] ABSTRACT

A bladed tool holder has vertical, elongated blocks spaced laterally from one another far enough to accept between them a blade of a tool to be held. The blocks have facing surfaces one of which has a sloping seat, opening toward the facing surface of the other, the seat sloping away from the other surface in a vertically upward direction at an angle preferably between 12 and 15 degrees. A ball, preferably of matte finished polypropylene, of a diamter to permit the ball to move freely in the seat but to project from the seat at the lower end of the seat, is mounted in the seat. In a holder for chisels and the like, in which the narrow side edges of the chisel are held between the ball and the facing surface, the ball is caged in the seat to preclude its falling out. A cap, bridging the space between successive blocks on the chisel holder, serves several functions, including protecting the sharp edge of the chisel from damage and protecting the user from injury.

2 Claims, 4 Drawing Sheets

BLADED TOOL HOLDER

BACKGROUND OF THE INVENTION

There are many holders for articles from brooms to sheets of paper, that rely upon hinged, camming, or rolling members, but none of the gravity biased type is believed to be capable of holding securely stainless steel knife blades, or chisels by their thin side edges, or wood saws, and to release them readily.

One of the objects of this invention is to provide a holder for bladed tools which is simple in construction, durable, and highly effective as compared with holders known heretofore.

Other objects of this invention will be apparent to those skilled in the art in light of the following description and accompanying drawings.

SUMMARY OF THE INVENTION

In accordance with this invention, generally stated, a bladed tool holder is provided that includes vertical, elongated blocks spaced laterally from one another a distance sufficient to accept between them a blade of a tool to be held, the blocks having facing surfaces one of which has a sloping seat, opening toward the facing surface of the other. The seat slopes away from the surface in a vertically upward direction at an angle, preferably between 12 and 15 degrees, and a plastic ball of a diameter to permit the ball to move freely in the seat but to project from the seat at a lower end of the seat, is seated in the seat. Preferably, the blocks are mounted on or are integral with a backing plate. In an embodiment particularly adapted to hold wood chisels, a multiplicity of pairs of blocks are provided along a substantially flat face of a backing plate, the blocks of each successive pair being spaced from one another a distance to accept chisels of different blade widths. In the chisel holder the seats in which the balls ride are partly in the backing plate and partly in a block, but the center line of the seats is forward (outwardly) of the backing plate, whereby, when a wood chisel is placed with its blade flat against the backing plate the ball in the seat engages a narrow side edge of the chisel blade. The chisel holder preferably has a cap extending between and closing the space between the blocks. The cap serves not only to close an upper end of the seat, but by bridging between the blocks and closing the space between them, it protects the sharp edge of the chisel against damage, and also protects the user from injury.

DESCRIPTION OF THE PREFERRED EMBODIMENT

Figures 1, 2:
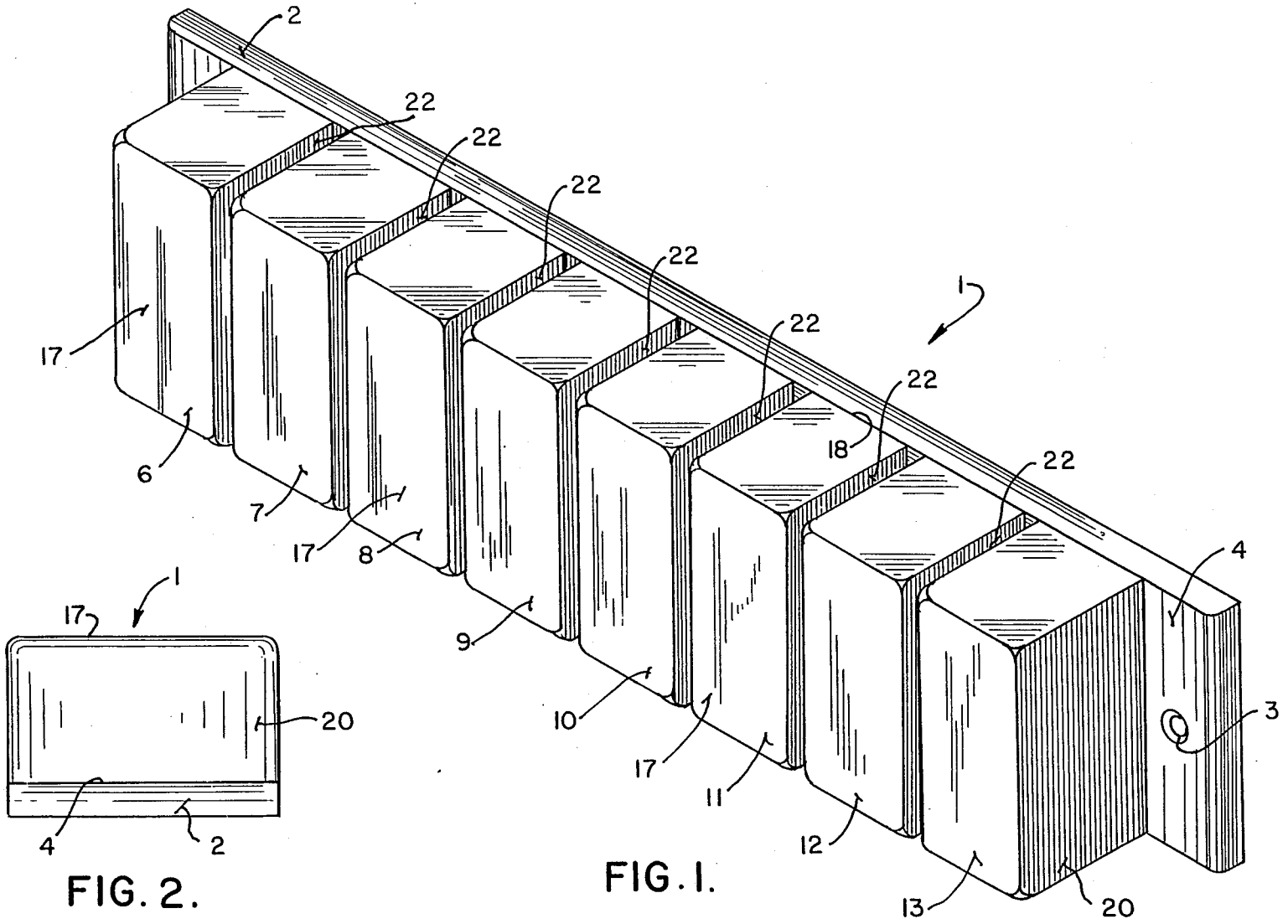
FIG. 1 is a view in perspective of one embodiment of bladed tool holder of this invention.
FIG. 2 is a view in end elevation.

Referring now to FIGS. 1 through 5, reference numeral 1 indicates one illustrative embodiment of bladed tool holder of this invention. The tool holder 1 has a backing plate 2, with screw holes 3 at either end, and blocks 6, 7, 8, 9, 10, 11, 12 and 13. Blocks 6 through 12 are identical. The block 13 is identical in size and shape, but it has two uninterrupted side surfaces 20. Each of the blocks has a front face 17 and a rear face 18 that abuts a flat front surface 4 of the backing plate 2. The blocks 6 through 12 have one uninterrupted side surface 20 and one interrupted side surface 22. Each of the interrupted side surfaces 22 has in it a seat 25, with side walls 27 and a bottom wall 28. The bottom wall 28 is substantially linear, but is sloped from the vertical upwardly in a direction away from the uninterrupted side surface 20 of the adjacent block, to provide a relatively deep upper end 29 and a shallow lower end 30 of the seat. In this embodiment, the seat 25 opens through the interrupted side surface 22 through its entire length. A ball 40 is seated for free movement in the seat 25.

Figure 3:
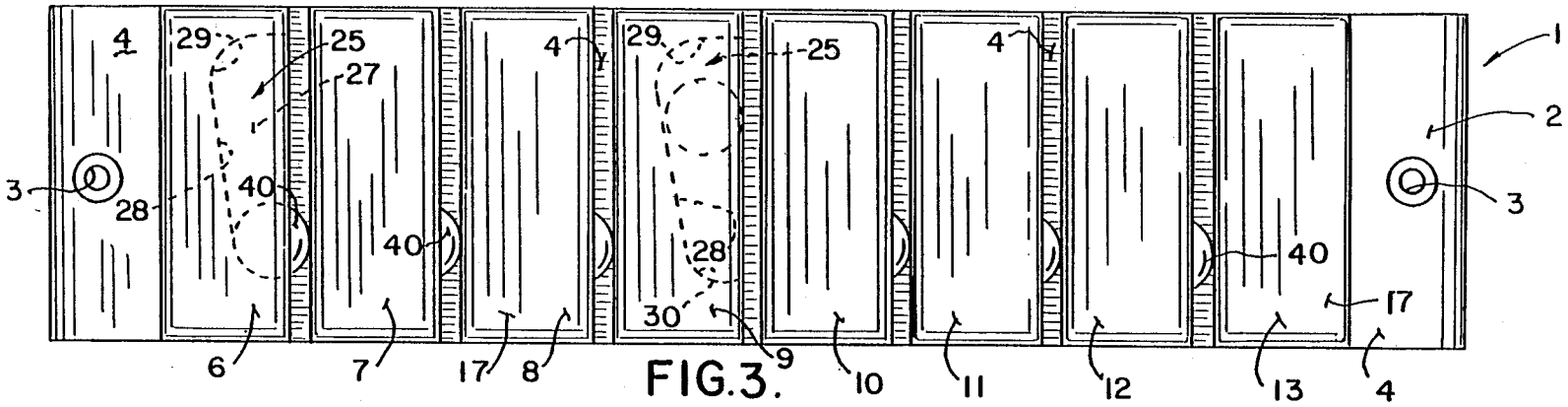
FIG. 3 is a view in front elevation.
Figure 4:
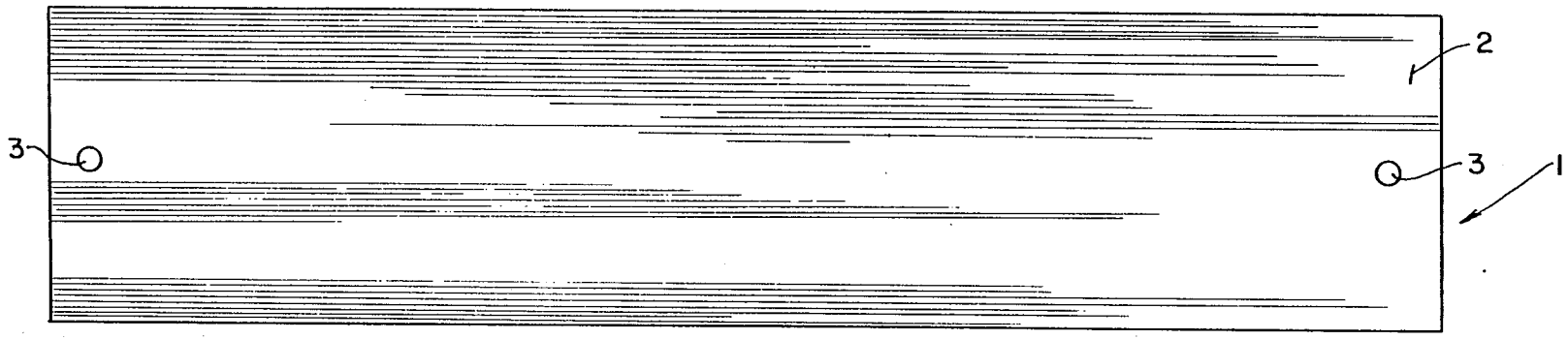
FIG. 4 is a view in rear elevation.
Figure 5:
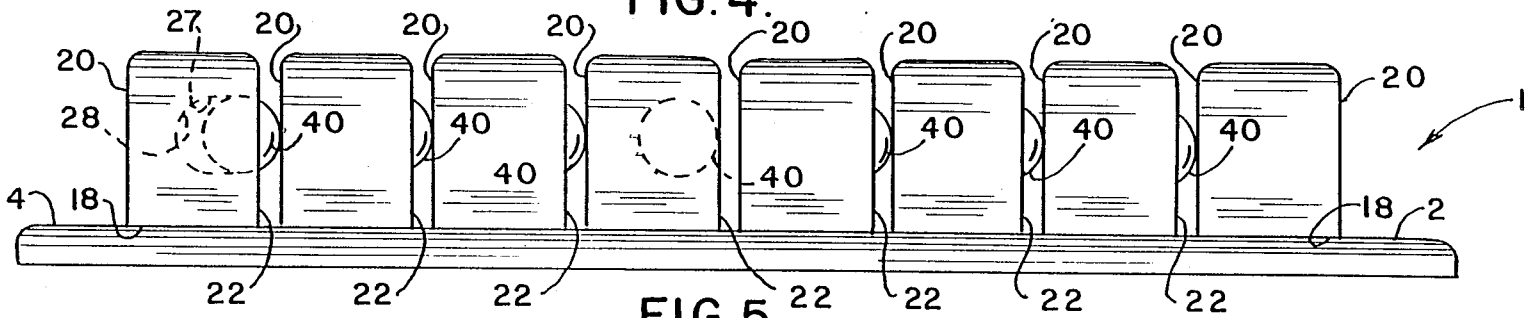
FIG. 5 is a top plan view.
Figure 6:
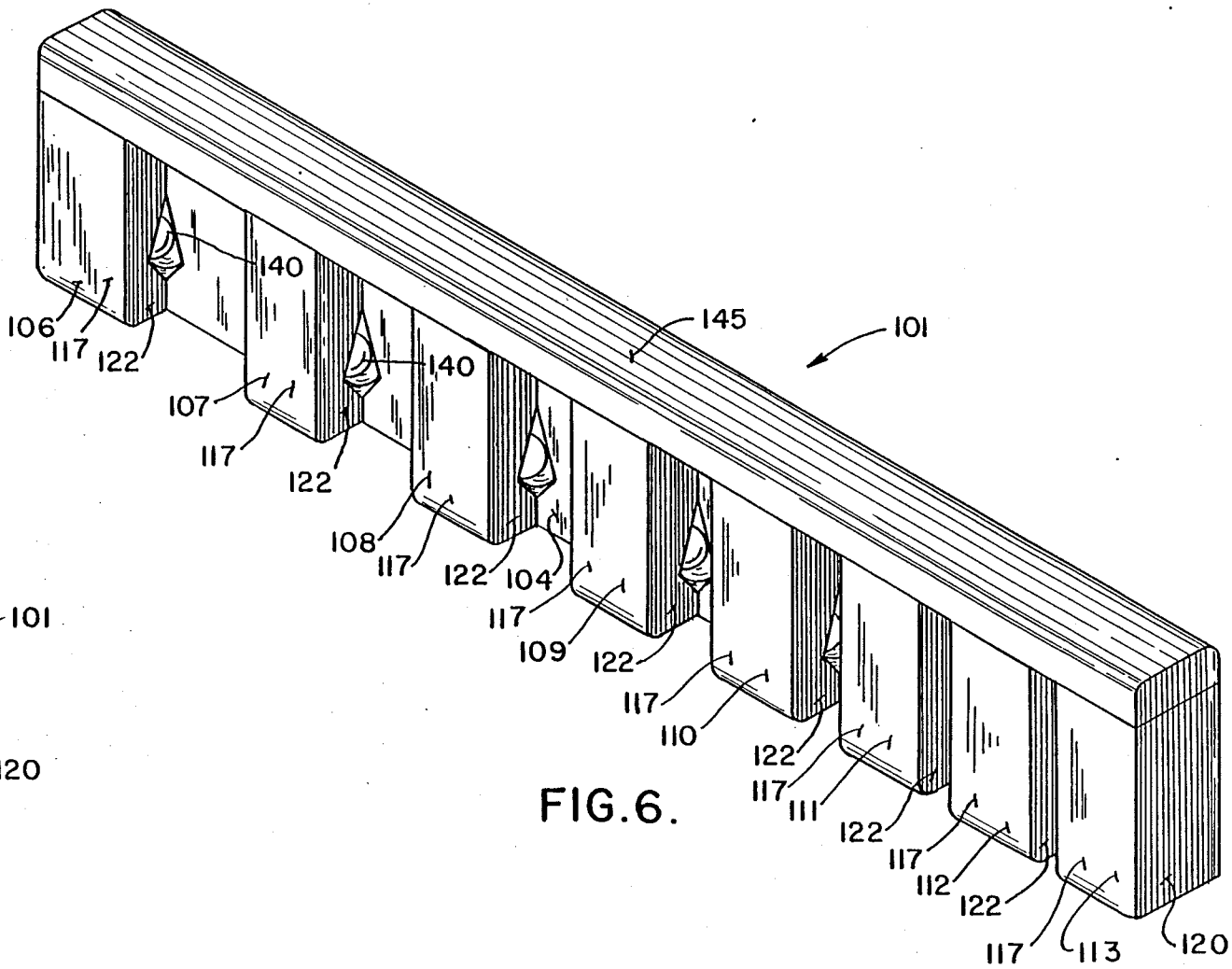
FIG. 6 is a view in perspective of a second embodiment of bladed tool holder of this invention, particularly adapted to hold chisels.
Figure 7:
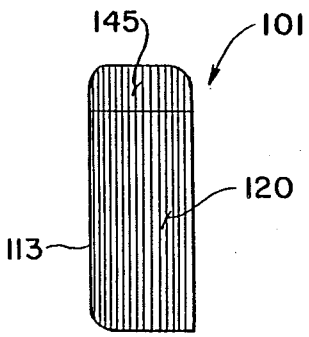
FIG. 7 is a view in end elevation.
Figures 8, 9, 10, 11:
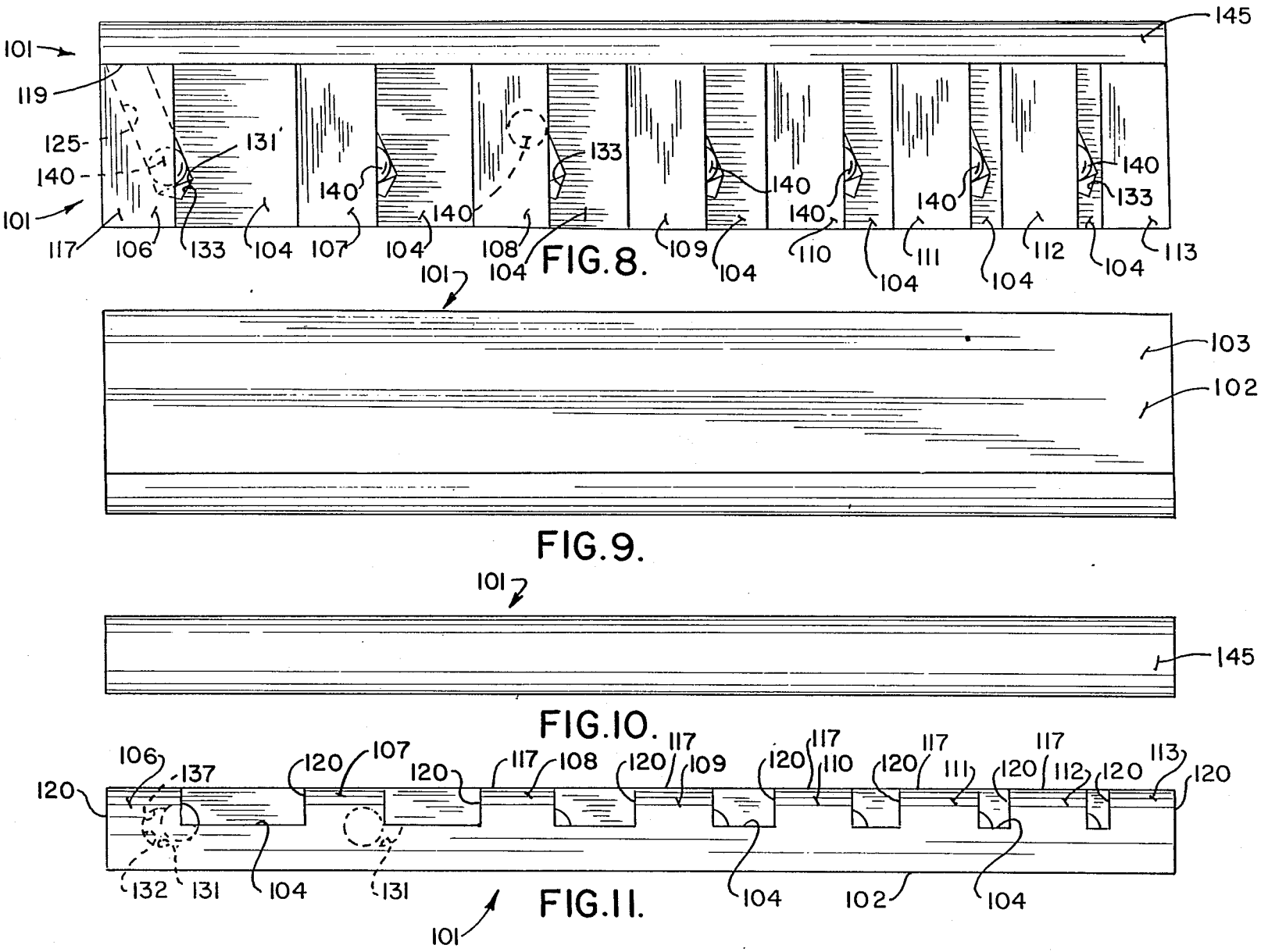
FIG. 8 is a view in front elevation.
FIG. 9 is a view in rear elevation.
FIG. 10 is a top plan view.
FIG. 11 is a bottom plan view.

The ball 40 is of a size, and the shallow lower end 30 of the seat 25 is of a depth to insure that the ball engages the uninterrupted side surface 20 of the adjacent block, as shown particularly in FIGS. 3 and 5. The ball is preferably made of polypropylene, with a rough or suede finish. Such balls are made by Orange Products Co. of Passaic, N.J. It has been found that when the inclination of the bottom wall of the seat is on the order of 12 to 15 degrees, the preferred embodiment of ball is capable of holding knives with stainless steel blades, and yet release the blade readily when the blade is moved upwardly in the slot between the blocks.

Merely by way of illustration, the backing plate and blocks can be made of wood, such as oak, the blocks can be two and a quarter inches high by seven eighths inches wide by one inch deep. The space between the successive blocks can be an eighth of an inch, the seat side walls can be spaced five eighths of an inch, the bottom wall can slope twelve degrees off the vertical, diverging from the facing uninterrupted surface in a direction from bottom to top. When the blocks are made of wood, the seat can be routed out of the individual blocks, a ball can be placed in each seat, and the blocks can be secured, as by gluing or screwing or nailing them to the backing plate.

The holder can be made of woods different from oak, or it can be made from plastic or, particularly for institutional use, of metal. Wood has the advantages of attractiveness, and protection against dulling of the sharp edges of the knives hung in the holder. Although the balls 40 are shown in FIG. 3 as engaging the uninterrupted surface of the neighboring block at the bottom of the seat, the seat can be made shallow enough so that the ball engages the surface at a place above the lower end of the seat, to compensate automatically for wear of the ball or of the uninterrupted surface. It is only necessary to leave enough of the seat above the resting place of the ball to accommodate the width of the blade, and to permit the blade easily to be removed when it is lifted.

Referring now to FIGS. 6 through 11 for a second embodiment of the holder of this invention, reference numeral 101 indicates a tool holder particularly adapted to hold wood chisels and the like. The tool holder 101 of this embodiment has a backing plate 102 integral with blocks !06, 107, 108, 109, 110, 111, 112 and 113. Like the block 13 of the first embodiment, the block 113 of this embodiment has two uninterrupted side surfaces 120. The remaining blocks have one uninterrupted side face 120, and one interrupted side surface 122. All of the blocks have a front surface 117. Each of the blocks 106 through 112 has an interrupted side surface 122. However, in this embodiment a seat 125 in each of the blocks 106 through 112 is formed in part within the backing plate 102, and opens through the interrupted face intermediate the length of the seat and of the interrupted face. The seat extends in a flat surface 104 of the backing plate between successive blocks, beyond the interrupted face, and terminates at a closed bottom end 133 which serves as a stop, caging a ball 140 between a backing plate seat side wall 131 and a block seat side wall 127, and the stop 133. In this embodiment, the seat has an open upper end 119, closed by a continuous cap strip extending from the outer edge block 106 to the outer edge of the block 113. The cap strip 145 serves not only to close the upper end of the seats 125, but, extending from a back surface 103 of the backing plate 102 to the front faces 117 of the blocks, closes the upper end of the channels between the blocks.

As is the case in the first embodiment described, the seats 125, which are linear, extend upwardly in a direction diverging from the uninterrupted faces, which are vertical, at an angle of 12 to 15 degrees. However, depending upon the nature of the tools, the slopes can be between 10 and 20 degrees.

As will be apparent from the drawings and the description, the seats 125 can be formed by drilling a hole from the top edge of the uncovered unitary block and backing plate. The ball is then dropped in, and the cap strip glued or otherwise secured.

As is evident from the drawing, for a chisel holder, the blocks are spaced progressively closer together from the end at which block 106 is, to the block 113, to accommodate different widths of wood chisel. The width should be one sixteenth of an inch wider than the chisel to be held. In order to insure that the chisel is securely held between the ball and the opposite uninterrupted side surface, the ball should project from the seat at its lower end sufficiently to insure that the point of contact of the ball lies on a diameter parallel to the plane of the flat front surface of the backing plate. Merely by way of example, with a half inch diameter ball, the diametric plane through the ball parallel with the front surface 104 should be 0.125 to 0.190 inches above the surface 104. Similarly, the ball should project from the plane of the interrupted surface of the block at least an eighth of an inch.

As in the case of the first embodiment, the ball is preferably a polypropylene ball with a rough or suede finish.

As in the first embodiment described, the chisel holder can be made of any desired wood, plastic or metal. In mounting the device of this embodiment, one can use an adhesive, or provide holes in the outermost blocks through which fasteners can be driven. Other means of mounting, such as double faced tape, velcro or magnetic strip can be employed. The blades of wood chisels are often tapered in thickness from the haft to the cutting edge, but the thin side edges are parallel. The taper of the blades makes holding such blades difficult in the widthwise direction, even in a holder such as that shown in the first embodiment.

In the second embodiment, by way of illustration, the total thickness of the blocks and backing plate in the embodiment illustrated can be one inch. The blocks, which are in this embodiment defined by routing vertical channels in a thick piece of stock, can be one half inch deep, measured to the flat front surface of the base plate. The cap can be one inch deep and one half inch high. The seat bore can be nine sixteenths, and the balls, one half inch in diameter. The distance from the flat front surface of the backing plate to the diametric plane through the ball parallel to the face, can be an eighth of an inch. The blocks can be two and one quarter inches high, and the seat can terminate one half inch above the lower edge of the backing plate. The backing plate can be made thinner if desired, and the rest of the dimensions can be varied, as long as the criteria for effective holding of the chisels are observed, particularly the slope of the seat and the exposure of the ball.

The first embodiment of holder can be made to hold hand saws. For that purpose, the blocks can again be, for example, two and a quarter inches high, but one and a quarter inches wide and one and a quarter inches deep, with a one eighth inch space between slots.

The outer edges of the blocks can be beveled or rounded.

In use, in the first embodiment, the knife or spatula or saw blade is simply inserted at the bottom and moved upwardly, the ball moving upwardly and outwardly with respect to the blade, until the blade passes beyond the ball. A slight downward movement of the blade then permits the ball to engage the side of the blade and force the opposite side into engagement with the contiguous uninterrupted surface. In the case of the chisel holder, the chisel of the appropriate width is placed with the broad back of the chisel flat against the flat front face of the backing plate, and moved upwardly as in the case of the knife or saw blade. The ball engages one narrow edge of the blade and the contiguous uninterrupted surface, the other. When a set of chisels is held in this way, the proper desired width of chisel is immediately apparent to the user.

The ornamental design of the holders of this invention can be varied in innumerable ways. The backing plate can be provided with a sort of pediment above the blocks. The blocks themselves may be differently shaped or proportioned. Although eight blocks have been shown in both embodiments, different numbers, more or fewer, can be used. The uninterrupted surface can be roughened or faced with a material with a higher coefficient of friction than the bare wood, plastic or metal. In the chisel holder, the cap strip 145 could be omitted, and the upper ends of the seats 125 plugged or covered with individual plates, but the cap strip does serve the additional functions of protecting the cutting edges of the chisels and preventing accidental cuts of the operator, which could be received if the edges of the chisels projected above the blocks. Similarly, the first embodiment can be provided with a cap strip to protect the user from the sharp points of knives that might otherwise project above the blocks. Although the plastic ball with suede finish has a number of advantages, other materials can be used, such as wood, steel or glass, the 12–15° angle of the seat being more critical in the case of the materials with a lower coefficient of friction. These variations are merely illustrative, and numerous other variations, within the scope of the appended claims, will become apparent to those skilled in the art in the light of the foregoing disclosure.

Having thus described the invention, what is claimed and desired to be secured by Letters Patent is:

1. A tool holder, particularly adapted to hold wood chisels, comprising a backing plate, a multiplicity of pairs of elongated blocks extending from said backing plate, blocks of successive pairs being spaced from one another a distance to accept chisels of different blade widths, said blocks having facing surfaces one of which has a sloping seat, opening toward the facing surface of the other, said seat sloping away from the said surface in a vertically upward direction at an angle of about 10 to 20 degrees, said seats being partly in said backing plate but having a center line forward of said backing plate, and a ball of a diameter to permit the ball to move freely in said seat but to project from said seat at the lower end of said seat, said seat extending more than 180 degrees around the ball at the lower end of said seat, and the diameter of the ball and the spacing of the blocks being such that the ball is spaced from the facing surface at the lowermost position of the ball, whereby, when a wood chisel is placed with its blade flat against said backing plate, the ball in the seat engages a narrow side edge of said chisel blade.

2. The holder of claim 1 including a cap piece extending across the top of the blocks and closing the upper end of the spaces between the blocks.

* * * * *